US005379961A

United States Patent [19]

Urban et al.

[11] Patent Number: 5,379,961

[45] Date of Patent: Jan. 10, 1995

[54] WINDING MACHINE FOR WINDING WEBS OF MATERIAL, PARTICULARLY PAPER OR CARDBOARD WEBS

[75] Inventors: Ernst-Günther Urban, Neuss; Reinhard Hehner, Haan, both of Germany

[73] Assignee: Jagenberg Aktiengesellschaft, Dusseldorf, Germany

[21] Appl. No.: 39,310

[22] PCT Filed: Sep. 18, 1992

[86] PCT No.: PCT/EP92/02155

§ 371 Date: Apr. 15, 1993

§ 102(e) Date: Apr. 15, 1993

[87] PCT Pub. No.: WO93/08110

PCT Pub. Date: Apr. 29, 1993

[30] Foreign Application Priority Data

Oct. 19, 1991 [DE] Germany ..... 4134648

[51] Int. Cl.[6] ..... B65H 18/16; B65H 23/26

[52] U.S. Cl. ..... 242/525.7; 242/541.1

[58] Field of Search ..... 242/56 R, 65, 66, 525.7, 242/541.1

[56] References Cited

U.S. PATENT DOCUMENTS

| | | | |
|---|---|---|---|
| 2,836,415 | 5/1958 | Rohdin | 271/2.3 |
| 3,433,429 | 3/1969 | Schnitzspahn | 242/65 |
| 3,648,342 | 3/1972 | Dorfel | 242/66 |
| 3,837,593 | 9/1974 | Dörfel | 242/66 |
| 3,912,186 | 10/1975 | Bruck et al. | 242/55 |
| 4,165,843 | 8/1979 | Wedig et al. | 242/66 |
| 4,541,585 | 9/1985 | Frye et al. | 242/66 |
| 5,165,618 | 11/1992 | Ruff | 242/56.4 |
| 5,240,198 | 8/1993 | Dörfel | 242/65 |

FOREIGN PATENT DOCUMENTS

| | | |
|---|---|---|
| 0139272A3 | 5/1985 | European Pat. Off. . |
| 0383704A1 | 8/1990 | European Pat. Off. . |
| 0393519A2 | 10/1990 | European Pat. Off. . |
| 0421232A1 | 4/1991 | European Pat. Off. . |
| 2100339 | 3/1972 | France . |
| 401212979A1 | 11/1991 | Germany . |

*Primary Examiner*—Daniel P. Stodola
*Assistant Examiner*—John P. Darling
*Attorney, Agent, or Firm*—Herbert Dubno; Yuri Kateshov

[57] ABSTRACT

A winding machine having a longitudinal cutting device for sectioning the web of material into individual webs includes two winding stations each provided with a winder bracket movable with respect to the web of material and having a guide head connected to a rotary drive and insertable into the winding core between the longitudinal cutting device and the winding stations a driven cylinder is arranged against which a roller having individual freely run segments, can be pressed for frictionally engaging the individual webs.

7 Claims, 2 Drawing Sheets

WINDING MACHINE FOR WINDING WEBS OF MATERIAL, PARTICULARLY PAPER OR CARDBOARD WEBS

CROSS REFERENCE TO RELATED APPLICATIONS

This application is a national phase application corresponding to PCT/EP92/02155 filed Sep. 18, 1992 and based, in turn, upon an application filed in Germany as P 41 34 648.3 filed Oct. 19, 1991 under the International Convention. This application is also related to our commonly owned application Ser. No. 07/778,873 filed Dec. 23, 1991 with which it is copending.

FIELD OF THE INVENTION

The invention relates to a winding machine for winding webs of material, particularly paper or cardboard webs onto winder cores, wherein the web of material is taken up from a supply roll, longitudinally sectioned into separate webs of material and then wound at individual winding stations, each consisting of two winder brackets transversely movable with respect to the web.

BACKGROUND OF THE INVENTION

In order to individually adjust the tensile stress of each winding roll during the winding operation, according to the German Patent Application P 40 12 979.9 (see corresponding copending application Ser. No. 07/778,873) the guide heads holding the winding roll, which are fastened to the winder brackets are each connected with a rotary drive. In order to set the tensile stress during winding at values which are different from the ones set for the longitudinal cutting operation, the tensile stress of the individual webs is interrupted after the longitudinal cutting and before the onset of the winding operation by guiding the web in frictional engagement over a driven cylinder. In order to produce this frictional engagement at the driven cylinder, a free-running roller which can be pressed against the driven cylinder nips the individual web, so as to insure that the contact pressure roller has enough stability even with a small diameter, it is made of separate segments, each supported to run freely and preferably with a length of 100 mm–500 mm, and which are rubber coated to avoid marks.

In wide winding machines (web width 8 m and more) it has proven to be difficult to insure that the contact pressure of the roller at the driven cylinder is uniform over the entire work width.

OBJECT OF THE INVENTION

It is an object of the invention to provide a winding machine having over the entire work width an even contact pressure of the freely rotatable rolls applied at the driven cylinder.

SUMMARY OF THE INVENTION

A winding machine for winding webs of material, particularly paper or cardboard webs, which are taken up on winding cores from a supply roll against a braking force, can have a longitudinal cutting device for separating the web of material into individual webs, and a winding station for each individual web consisting of two winder brackets movable with respect to the web, whereby on each winder bracket a guide head connected with a rotary drive is mounted, and with a driven cylinder (support cylinder) arranged for web traction interruption between the longitudinal cutting device and the winding stations and a free running roller which can be pressed against the cylinder for frictional engagement, whereby this contact pressure roller consists of individual segments. Each of the segments is supported so that it can run freely. The segments are supported next to each other on an elastically bendable axle or shaft by radial bearings. The axle or shaft is fastened parallel to the axis of the driven cylinder (support cylinder) to a bending-resistant crossrail extending across the work width. Between any two segments a setting element (piston-cylinder-unit) fastened to the bending-resistant crossrail, engage the axle and presses in the direction towards the driven cylinder (support cylinder).

The winding machine of the invention offers the possibility of variable settings of the contact pressure over the work width, in order to influence the tensile stress at each winding station, depending on the buildup of the winding roll.

The segments can consist of a basic body which is a hollow cylinder of light metal, preferably aluminum, and has a smooth, rubber coated outer shell. The segments can each be supported on two radial bearings (29) arranged at their axial ends. The winding stations can be arranged on both sides of the driven cylinder (support cylinder), the guide heads being radially movable with respect to the support cylinder and the roller segments being pressed against the support cylinder.

While the light-metal construction according to the invention minimizes flexure due to its own weight.

Further, the winding machine of the invention includes support cylinders, wherein the driven support cylinder serves at the same time as the driven cylinder for traction interruption.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
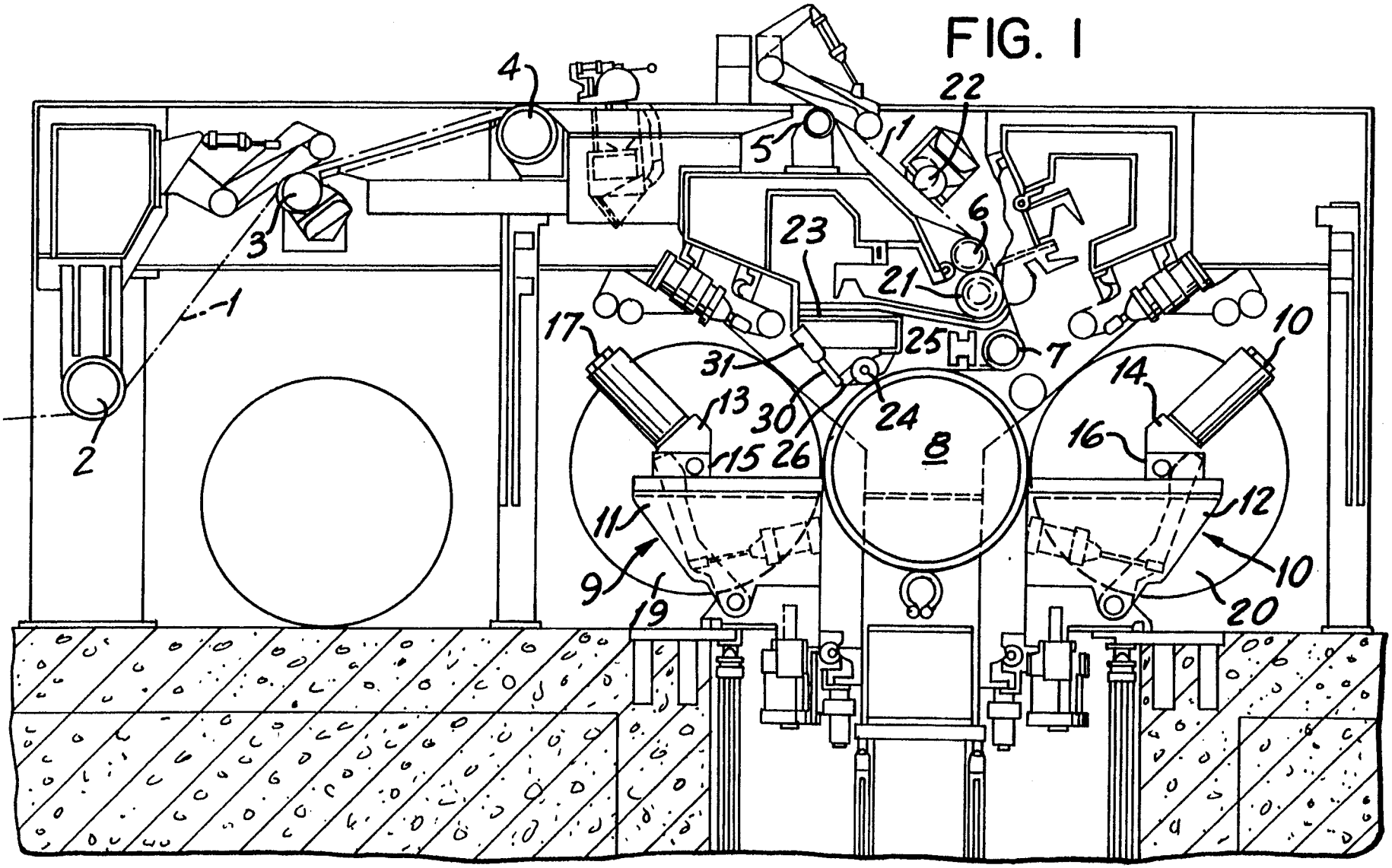
FIG. 1 is a lateral elevational view of the winding machine with support cylinders according to the invention.

The material web 1, in the present example a paper web, taken up from a supply roll not shown in the drawing is guided by guide rollers 2 to 7 from above towards a driven support cylinder 8. On both sides of the support cylinder 8, winding stations 9, 10 are arranged, each of them consisting of two winder brackets 11, 12, movable parallel to the axis of the support cylinder. Each winder bracket 11, 12 carries at its upper side a slide 13, 14 radially displaceable with respect to the support cylinder 8, to which a guide head 15, 16 with its rotary drive 17, 18 is fastened. In order to hold and drive the winding rolls 19, 20, the guide heads 15, 16 can be inserted in their winder cores.

Between the guide cylinders 4 and 5 the web runs on the incoming side above the support cylinder 8 in a somewhat horizontal direction, after that it is deflected downwards by each of the guide rollers 5, 6, to the guide roller 7 arranged above and slightly offset with respect to the support cylinder 8. In the area between the guide rollers 6 and 7 a longitudinal cutting device 21 with pairs of circular knives is arranged, which can be adjusted across the travel direction of the web in order to set the format width of the individual webs. In front of the longitudinal cutting device 21 between the guide rollers 5 and 6 there is a width stretching device 22. The guide roller 7 arranged as close as possible to the support cylinder 8 guides the individual webs of material 1 produced by longitudinal cutting somewhat horizontally towards the support cylinder 8, from where they are guided peripherally adhering towards the winding stations 9, 10.

Figure 2:
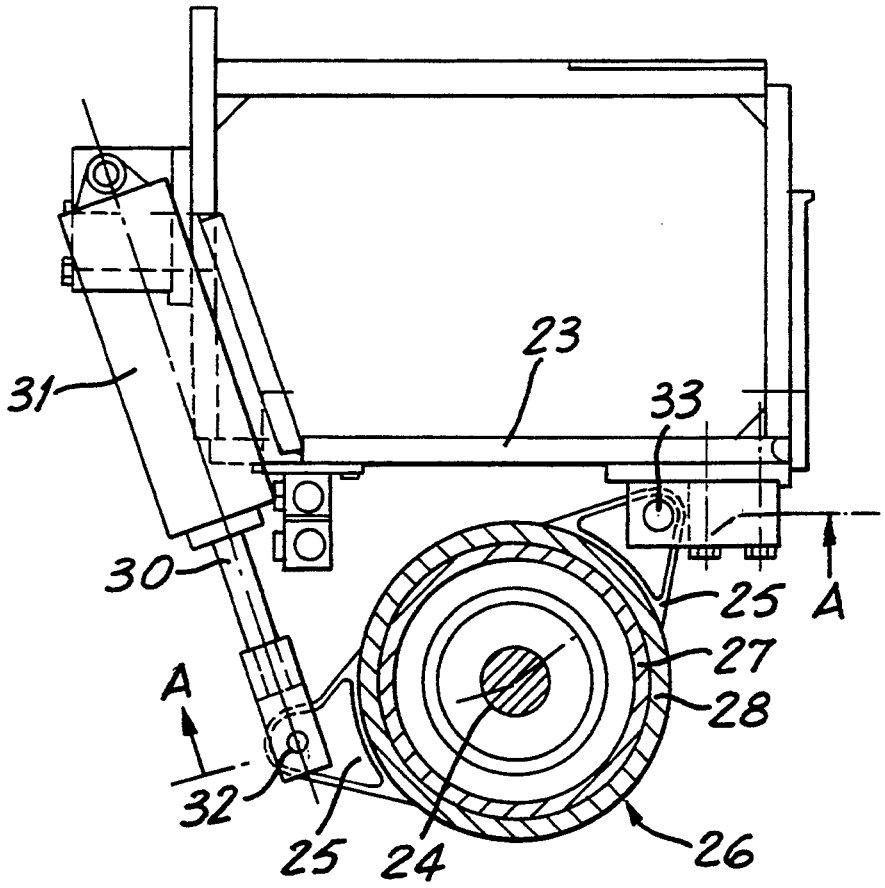
FIG. 2 is an enlarged cutout of the construction and support of the freely rotatable rollers.
Figure 3:
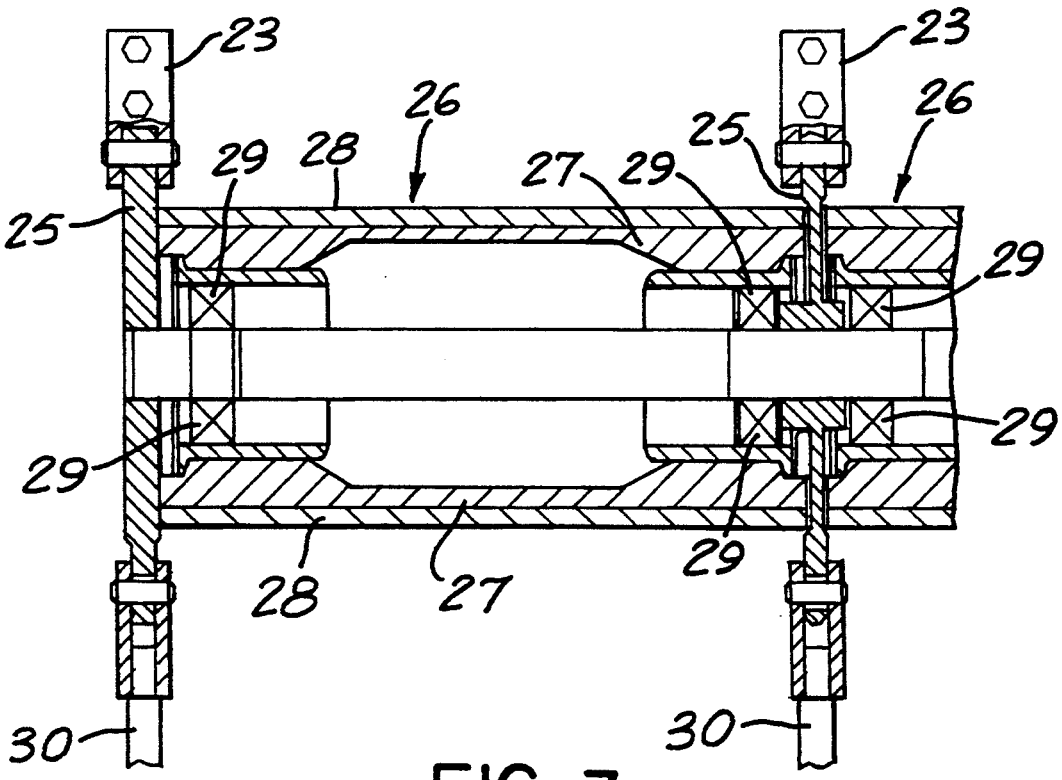
FIG. 3 is a cutout of the longitudinal section along line A—A in FIG. 2.

A bending-resistant crossrail 23 extends over the entire work width above the wrapped area of the support cylinder 8, between the apex line of the support cylinder 8 and the incoming-side winding stations 9 and is represented in FIG. 2 on a larger scale.

On the bottom side of crossrail 23 an elastically bendable axle 24 is fastened parallel to the axis of the support cylinder by mountings 25 so that it can swing in the direction of the support cylinder. On the axle 24 independently rotatable roller segments 26 are arranged next to each other, each consisting of basic body 27 made of light metal, preferably aluminum, and shaped like a hollow cylinder whose outer peripheral surface is coated by a smooth rubber layer 28. At both perspective axial ends of each roller segment 26 a radial bearing 29 is fitted in the basic body 27, whose inner ring race is fastened to the axle 24. The roller segments have a length of 100 mm to 500 mm.

The mountings 25 are arranged on both ends of the axle 24, each between two roller segments 26. They have approximately the shape of a disk with a central bore for the axle 24 and two approximately opposite widened portions shaped like tongues. At one of these widened portions the mountings 25 are linked to the crossrail 23 at eyelet 33, and at the opposite widened portion the ends of a piston 30 of a hydraulic or pneumatic piston cylinder unit 30, 31 is respectively linked at eyelet 32 and whose cylinder 31 is fastened to the crossrail 23. The piston-cylinder units 30, 31 acting as setting elements press the mountings 25 with the roller segments 26 supported thereon against the support cylinder 8 in the area wrapped by the webs 1 with an individually adjustable pressure, in order to cut off the traction of the webs 1 before they reach the winding stations 9, 10. The contact pressures of the piston-cylinder units 30, 31 are each controlled in such a way that over the entire work width an even line force within the range of 5 and 25 N/cm is established.

In the described embodiment example the support cylinder 8 serves not only for driving the winding roll 19, 20, but also as a driven cylinder which in cooperation with the roller segments 26 interrupts the traction of webs 1 before they reach the winding stations 9, 10. This is possible because the traction required for winding is generated downstream of the nipping location by drives 17, 18 via guide heads 15, 16. In winding machines without driven guide heads or support cylinders, a separate counter cylinder for the roller segments 26 is provided for the interruption of traction.

We claim:

1. A device for winding up of paper or cardboard material web transported along a web path, the device comprising:

slitting means along a web path for subdividing the web into individual longitudinal strips;

a driven support roller downstream of the slitting means rotatable about a support axis and receiving the strips;

a pair of winding stations spaced radially from the support axis to opposite sides thereof for withdrawing the strips from the support roller, each of the winding stations including:

a respective winder bracket for each individual strip and movable relatively to the web, a respective guide head mounted on the winder bracket, and a respective rotary drive operatively connected with the guide head for rotatably driving a respective winding roll winding up a respective strip from the support roll; and pressure means downstream of the slitting means along the web path and juxtaposed with the support roller for controlling a tensile stress at each of the winding stations in response to the build up of the web thereon, the pressure means comprising:

a bend-resistant crossrail extending across a work width of the support roller, an elastically bendable continuous axle mounted on the crossrail and extending parallel to the support axis, a plurality of individual roller segments mounted in a row on said bendable axle, each of the roller segments being provided on respective opposite axial ends thereof with a respective pair of radial bearings supporting the roller segment on the bendable axle, and a plurality of piston and cylinder units mounted on the crossrail and operatively connected with the bendable axle between neighboring roller segments and forcing the axle toward the support cylinder to engage individual strips over the work width by the respective roller segments driven by the strips upon contact therewith.

2. The device defined in claim 1 wherein each of the roller segments includes a respective hollow cylinder made of a metal and formed with a respective smooth coated outer shell.

3. The device defined in claim 1, further comprising a plurality of discs formed with respective central bores, each of the disks being mounted on the bendable axle and supporting a respective roller segment and being formed with:

a respective pair of widening portions extending radially oppositely from the bending axle, and respective connecting means for rotatably connecting one portion of the pair with the crossrail and the other portion with a respective piston and cylinder unit which includes a respective piston reciprocally displaceable along a piston axis inclined to a vertical.

4. The device defined in claims 3 wherein said connecting means includes an eyelet formation on each portion of the respective pair of widening portions.

5. The device defined in claim 1 wherein the piston and cylinder units are pneumatic piston and cylinder units.

6. The device defined in claim 1 wherein the piston and cylinder units are hydraulic piston and cylinder units.

7. The device defined in claim 1 wherein the guide heads of the widening stations are mounted so as to be readily movable from and toward the support axis.

* * * * *